US008390525B2

(12) United States Patent
Lopez

(10) Patent No.: US 8,390,525 B2
(45) Date of Patent: Mar. 5, 2013

(54) CIRCULARLY POLARIZED OMNIDIRECTIONAL ANTENNAS AND METHODS

(75) Inventor: Alfred R. Lopez, Commack, NY (US)

(73) Assignee: BAE Systems Information and Electronic Systems Integration Inc., Greenlawn, NY (US)

( * ) Notice: Subject to any disclaimer, the term of this patent is extended or adjusted under 35 U.S.C. 154(b) by 439 days.

(21) Appl. No.: 12/660,899

(22) Filed: Mar. 5, 2010

(65) Prior Publication Data

US 2011/0215979 A1 Sep. 8, 2011

(51) Int. Cl.
*H01Q 13/10* (2006.01)

(52) U.S. Cl. ..... 343/770

(58) Field of Classification Search ..... 343/770, 343/702, 725, 769, 820
See application file for complete search history.

(56) References Cited

U.S. PATENT DOCUMENTS

| | | | | |
|---|---|---|---|---|
| 4,959,657 | A * | 9/1990 | Mochizuki | 343/725 |
| 5,175,561 | A * | 12/1992 | Goto | 343/769 |
| 7,339,542 | B2 * | 3/2008 | Lalezari | 343/773 |
| 7,456,799 | B1 * | 11/2008 | Cohen | 343/773 |
| 7,583,236 | B1 * | 9/2009 | Lopez | 343/820 |
| 2002/0097111 | A1 * | 7/2002 | Holden et al. | 333/125 |

* cited by examiner

*Primary Examiner* — Huedung Mancuso
(74) *Attorney, Agent, or Firm* — Kenneth P. Robinson; Daniel J. Long

(57) ABSTRACT

An antenna, suitable for battlefield identification use, employs a multifunctional design. A closed-end coaxial line structure with center conductor has slanted slot radiators provided in its outer conductor. The slot radiators excite a pattern between upper and lower disks of a radial waveguide radiator configuration so that horizontal and vertical components reach the disk circumference with a 90 degree phase differential to provide an omnidirectional antenna pattern of circular polarization. Antennas and methods are described.

15 Claims, 5 Drawing Sheets

IMPEDANCE LOCUS, 36.7-37.0 GHz

CIRCULARLY POLARIZED OMNIDIRECTIONAL ANTENNAS AND METHODS

RELATED APPLICATIONS (Not Applicable)

FEDERALLY SPONSORED RESEARCH (Not Applicable)

BACKGROUND OF THE INVENTION

This invention relates to communication antennas and methods and, more specifically, to antennas and methods suitable for omnididirectional reception and transmission of circularly polarized signals.

Many forms of antennas capable of omnidirectional operation with circular polarization have previously been described. However, for applications such as battlefield discrimination between friendly and unfriendly vehicles and other platforms there is a need for small, economical and efficient antennas capable of reliably receiving and transmitting information suitable for platform identification purposes and additional communication purposes as may be appropriate.

Objects of the present invention are, therefore, to provide new and improved antennas and methods suitable for reception and transmission via onmidirectional circularly polarized antenna patterns.

SUMMARY OF THE INVENTION

In accordance with the invention, an embodiment of an antenna providing an omnidirectional antenna pattern includes a cylindrical structure, which may have the form of a closed-end coaxial line section, a center conductor, which may be the center conductor of the coaxial line section, and upper and lower disk members, which may form a radial waveguide radiator. The cylindrical structure may have a square-pipe cylindrical side portion including four slanted openings forming slot radiators, one in each side of the square-pipe configuration. The upper and lower disk members may extend in parallel relation outward from the coaxial line section forming the radial waveguide radiator which is arranged to receive excitation from the coaxial line section, via the four slot radiators. The radial waveguide radiator may be configured to provide an omnidirectional right-hand circularly polarized antenna pattern.

Also in accordance with the invention, a method, for providing an omnidirectional circularly polarized antenna pattern, may include the steps of:

(a) energizing a closed-end coaxial line section having a center conductor and an outer conductor;

(b) responsive to step (a), exciting a radiation pattern external to the coaxial line section via a plurality of slanted radiator slots in the outer conductor; and (c) responsive to step (b) exciting a radial waveguide radiator, formed by upper and lower disks extending outward in parallel relation from the outer conductor respectively above and below the radiator slots, to provide an omnidirectonal circularly polarized antenna pattern.

In step (c) of the method, responsive to step (b) horizontal TE mode and vertical TEM mode components may be excited to arrive at the outer circumference of the upper and lower disks with a 90 degree phase differential to provide an omnidirectional right hand circularly polarized antenna pattern.

For a better understanding of the invention, together with other and further objects, reference is made to the accompanying drawings and the scope of the invention will be pointed out in the accompanying claims.

DESCRIPTION OF THE INVENTION

Figure 1:
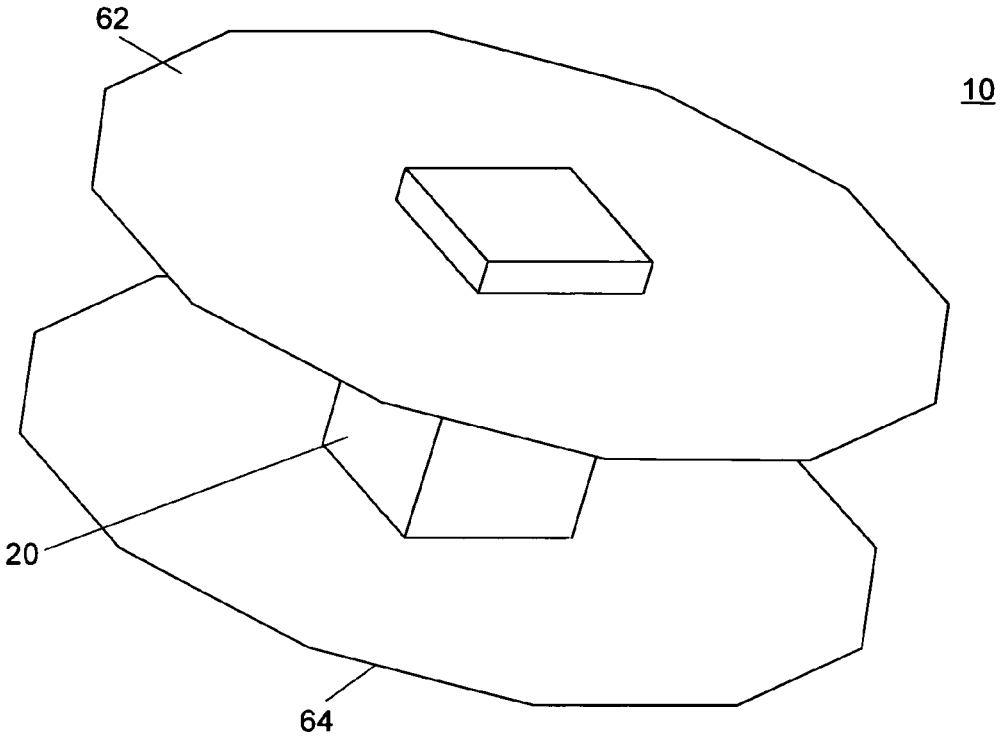
FIG. 1 is a perspective view of an embodiment of an antenna utilizing the invention.
Figure 2:
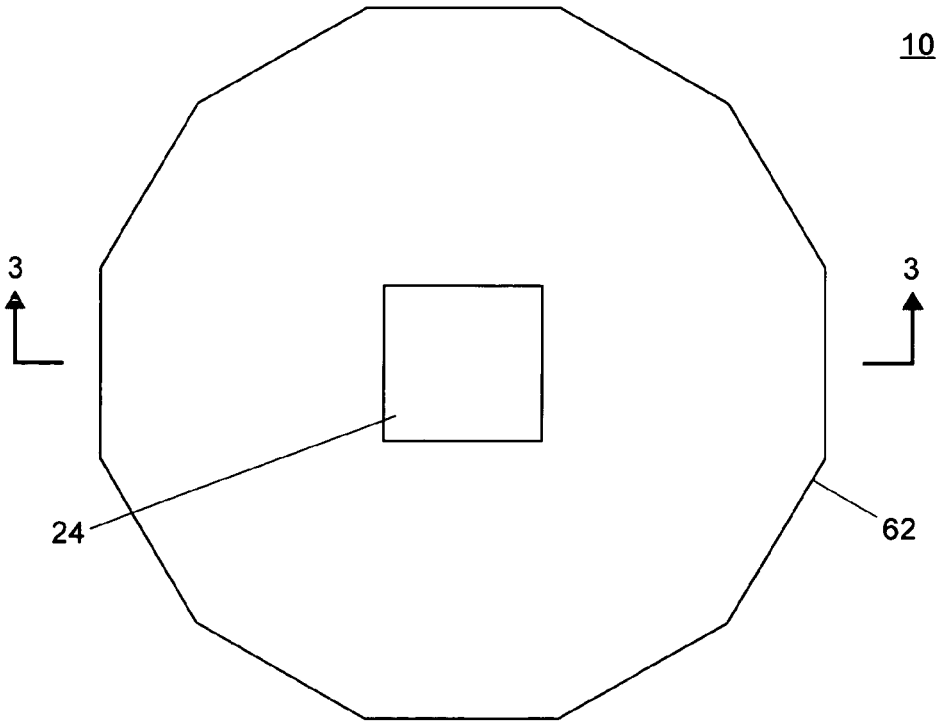
FIG. 2 is a top view of the FIG. 1 antenna.
Figure 3:
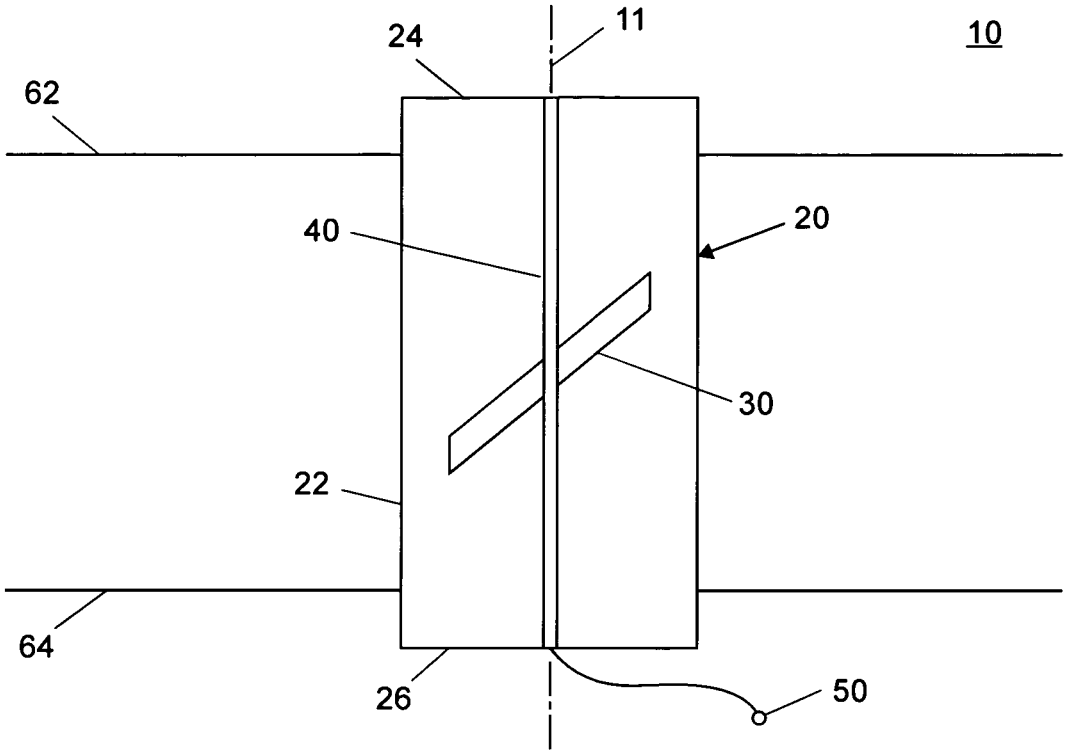
FIG. 3 is a side sectional view taken along line 3-3 of FIG. 2.

FIG. 1 is a perspective view, FIG. 2 is a top view and FIG. 3 is a side sectional view of an antenna 10 in accordance with a presently preferred embodiment of the invention configured to provide an omnidirectional right-hand circularly polarized antenna pattern.

The antenna 10 of FIGS. 1, 2 and 3 includes a cylindrical structure 20 with a vertical center axis 11 and having a cylindrical side portion 22 with upper and lower closures 24 and 26. Side portion 22 has a plurality of slanted openings 30 and has a height of nominally one wavelength and a width of nominally one-half wavelength at an operating frequency. As shown, cylindrical side portion 22 has a square cross section with a slanted opening 30 (e.g., a diagonal slot) in each of its four sides (see also FIG. 4). As shown, closures 24 and 26 comprise horizontal conductive surfaces. In other embodiments, side portion 22 may be of circular or other suitable cross section.

The antenna also includes a center conductor 40 extending within cylindrical structure 20 along its center axis. Center conductor is supported within, but electrically isolated from, cylindrical structure 20. As represented in FIG. 3, an input/output port 50 is coupled to center conductor 40 via a cable, which may have a coaxial outer conductor (not shown) coupled to cylindrical structure 20.

The antenna, as illustrated, further includes upper and lower disk members 62 and 64 extending in parallel relation outward from side portion 22 of the cylindrical structure 20 respectively above and below the slanted openings 30. While disk members 62 and 64 are illustrated as having a twelve-sided perimeter, in production this perimeter may desirably be circular.

In use, the antenna may be coupled to a receiver/transmitter configuration, such as transponder or interrogator/transponder equipment of the type used for IFF (Identification Friend or Foe) operations. Thus, a given battlefield platform may merely provide a coded reply to an identification query or may also have the capability to interrogate other platforms for identification purposes. Other communication capabilities may also be provided utilizing the antenna.

Figure 4:
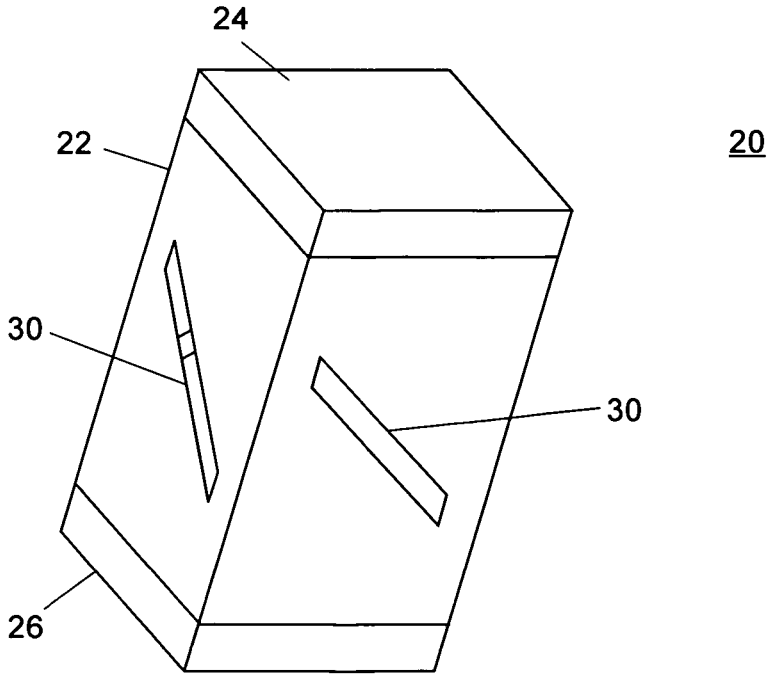
FIGS. 4 and 5 are perspective views of portions of the FIG. 1 antenna provided as descriptive aids.
Figure 5:
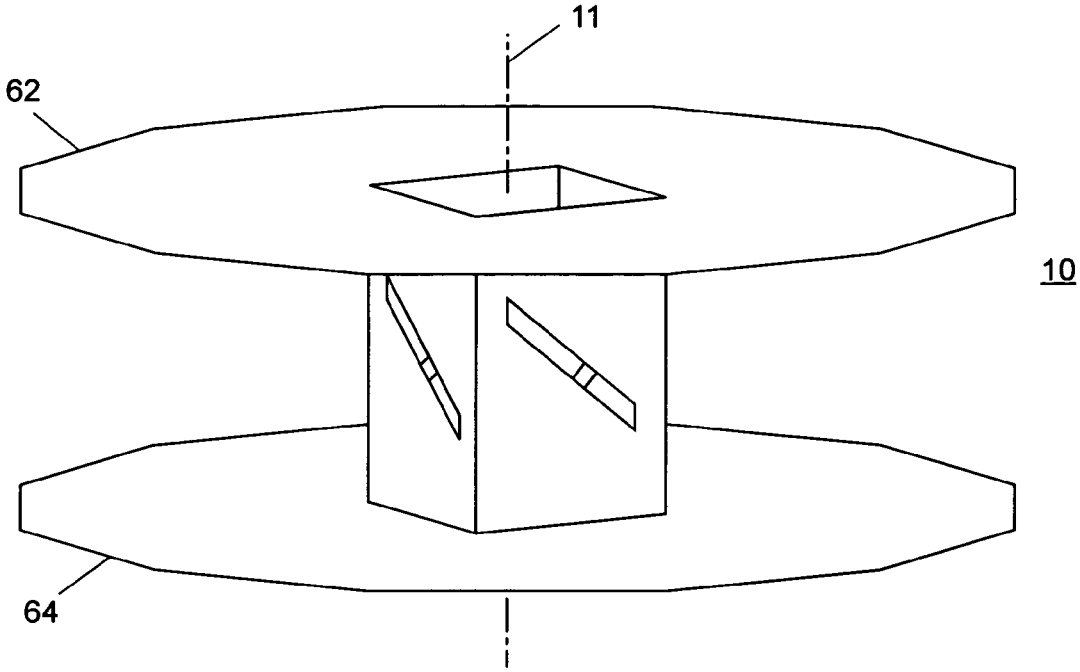

Referring now to FIGS. 4 and 5, there are illustrated portions of the antenna of FIGS. 1, 2 and 3 which are more associated with particular functional aspects of the operation of the antenna.

FIG. 4 shows the cylindrical structure 20 of the FIG. 1 antenna, with the disk members 62 and 64 removed. Cylindrical structure 20 is referred to alternatively as coaxial line section 20. Thus, structure 20 is constituted as a coaxial line section having a vertical center conductor 40 (see FIG. 3) and an outer conductor 22, in the form of the cylindrical side portion as described above. In this embodiment, structure 20 thus has the form of a square-pipe coaxial line nominally one wavelength in length (height in FIG. 3) and nominally one-half wavelength in side-to-side width, which may be energized via input/output port 50. For present purposes, the term "nominally" is defined as a value within plus or minus 15 percent of a stated value.

When energized, cylindrical structure 20 excites a radiation pattern external to the coaxial line section (i.e., external to outer conductor 22) via the slanted openings 30, referred to alternatively as slot radiators 30. Thus, the slanted openings have the form of slot radiating elements (slot radiators) inclined at nominally 50 degrees relative to the center axis and are effective to excite a radiation pattern between the upper and lower disk members 62 and 64. In this configuration, the slot radiators 30 may have a length of nominally 0.4 wavelength at an operating frequency, with a width which is small relative to that length, as illustrated. For present purposes, the term "an operating frequency" is defined as a frequency within an operating bandwidth of the antenna.

FIG. 5 shows first and second disk members 62 and 64 with the portion of coaxial line section 20 located between the disk members included. These portions of the antenna, as shown in FIG. 5, are configured as a radial waveguide radiator. Thus, the disk members extending in parallel from the central portion of coaxial line section 20 form a section of radial waveguide that is excited by the four slanted slot radiators 30. In this embodiment, disk members 62 and 64 have a vertical spacing from each other of nominally 0.8 wavelength and a diameter of nominally 2.8 wavelengths, at an operating frequency.

The slot radiators 30 are effective to excite vertical and horizontal field components in the space between the disk members. The propagation constant for the vertical component (TEM mode) is near that of free space, while waveguide propagation (TE mode) is characteristic of the horizontal component. As a result, the horizontal component advances relative to the vertical component during propagation toward the outer edges of the disks. The configuration of the radial waveguide extending between the disks, and particularly the radius (determined by the disk diameter) of that waveguide, is specified so that the phase of the horizontal component leads that of the vertical component by 90 degrees at the outer circumference of the radial waveguide (i.e., at the disk perimeter edge). In this way, the radial waveguide is excited, in response to the radiation pattern of the slot radiators, to provide an omnidirectional circularly polarized antenna pattern and, more particularly, such a pattern of right-hand circular polarization. While signal transmission terminology may be used for convenience of description, it will be understood that antenna components operate reciprocally to provide excitation to enable received signals to be provided to the input/output port, as well as to enable transmission of signals provided to that port.

Figure 6:
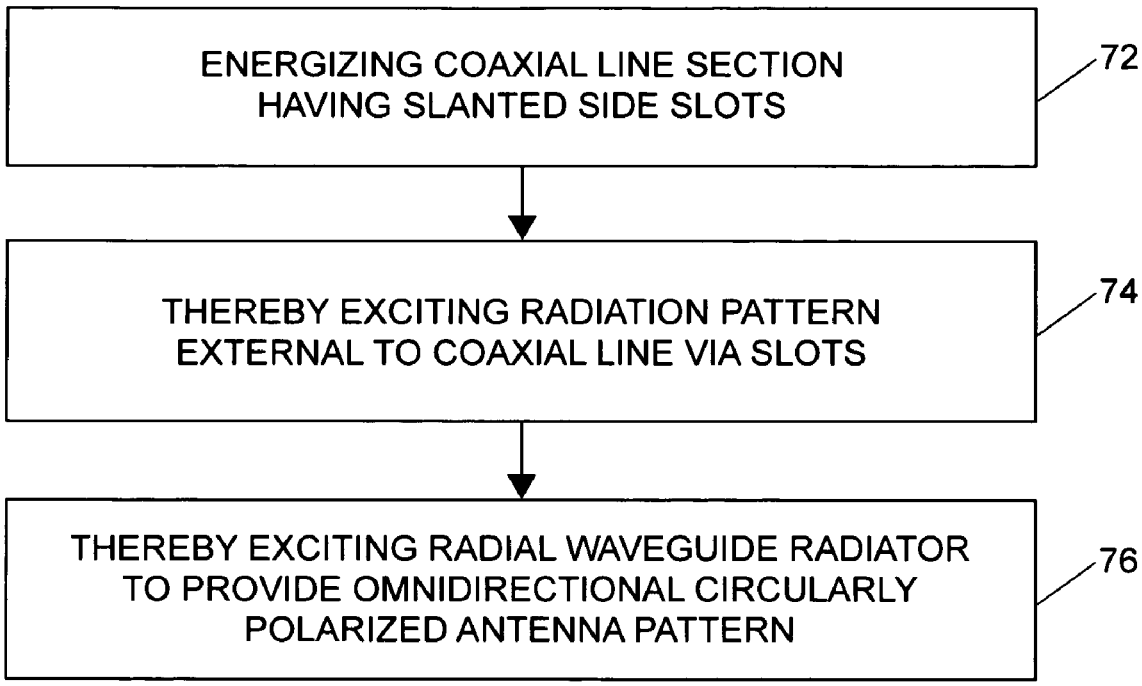
FIG. 6 is a flow chart diagram of a method utilizing the invention.

Consistent with the foregoing, FIG. 6 provides a diagram of a method for providing an omnidirectional circularly polarized antenna pattern in accordance with the invention, including the following steps.

At 72, energizing a closed-end coaxial line section 20 having a center conductor 40 and an outer conductor 22 including a plurality of slot radiators 30.

At 74, responsive to energizing the coaxial line section 20, exciting a radiation pattern external thereto via the slot radiators 30.

At 76, responsive to the slot radiator radiation pattern, exciting a radial waveguide radiator, formed by upper and lower disks 62 and 64 extending outward in parallel relation from outer conductor 22, to provide an omnidirectional circularly polarized antenna pattern.

Figure 7:
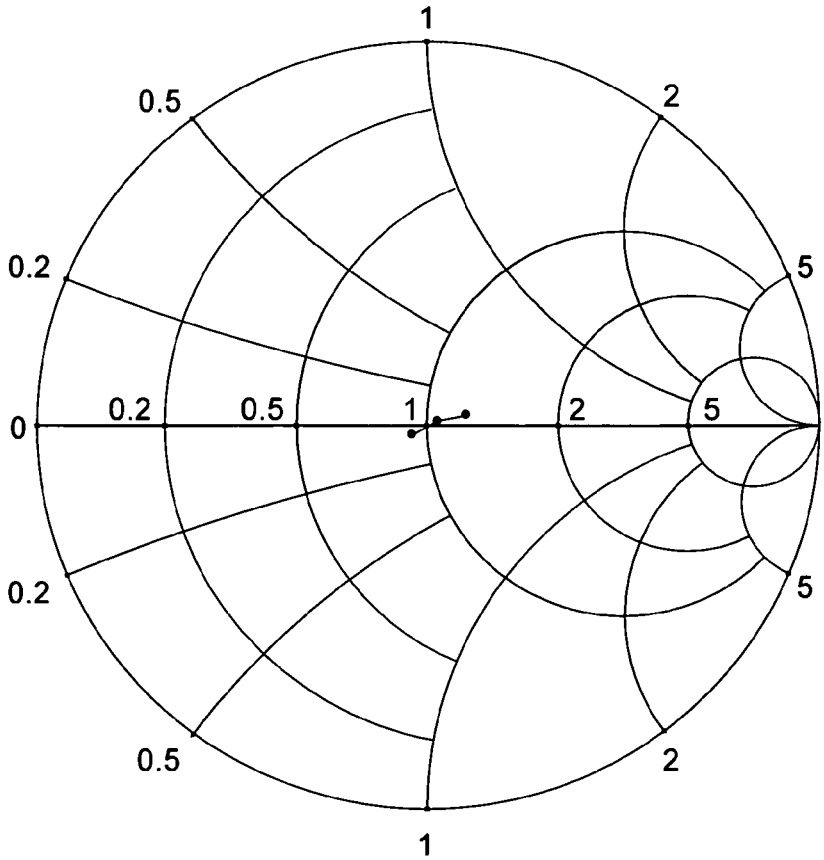
FIG. 7 presents impedance locus data.

The antenna in this embodiment is double tuned. The coaxial cavity provided by coaxial line section 20 forms one tuned circuit. The Q of this coaxial cavity is controlled by the impedance level of the coaxial line. The radial waveguide (e.g., as shown in FIG. 5) provides a second tuned circuit. The resonant frequency is controlled by the length of the slots 30. For narrow bandwidth operation (e.g., 36.7 to 37.0 GHz) double tuning is not required to achieve suitable impedance matching. Double tuning, however, does facilitate centering of the impedance locus. FIG. 7 shows a computed impedance locus for this embodiment over the above band.

Figure 8:
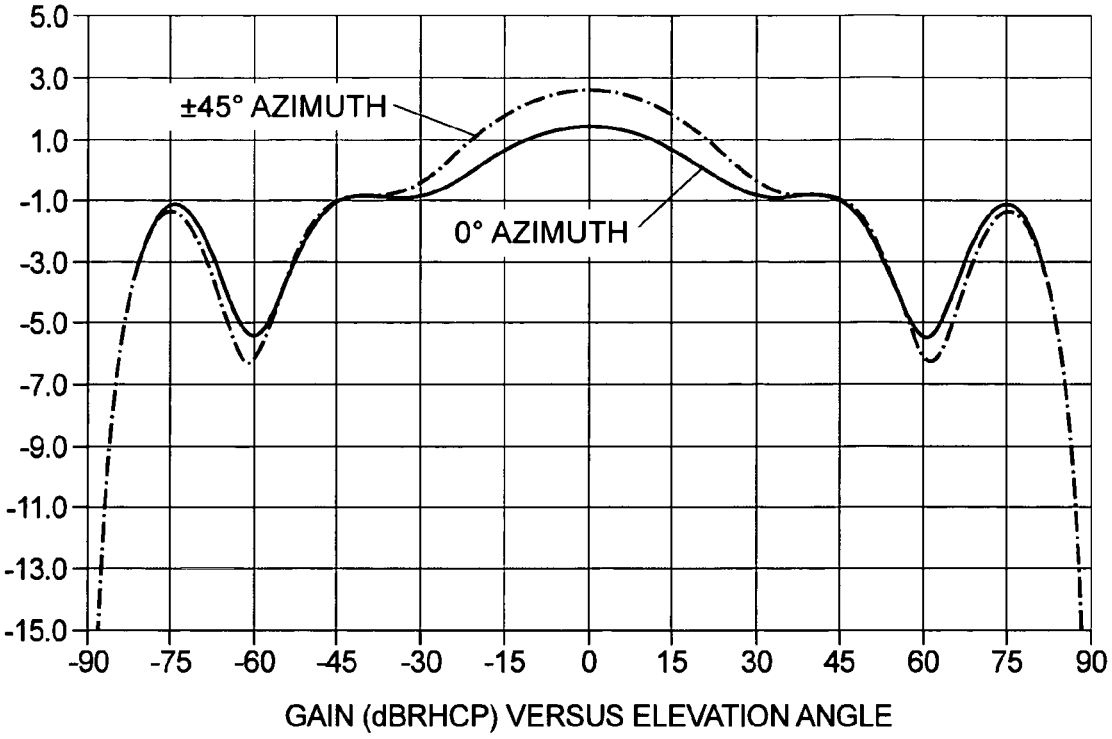
FIG. 8 presents gain versus elevation data at both zero degrees azimuth and 45 degree azimuth offsets.
Figure 9:
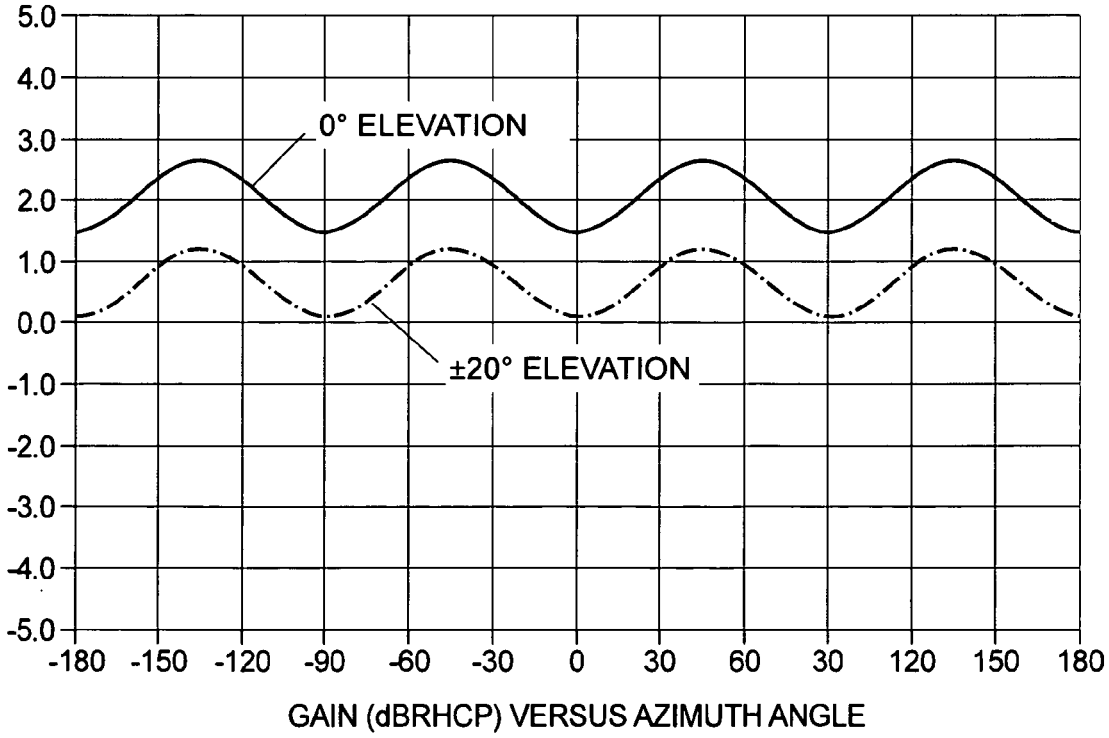
FIG. 9 presents gain versus azimuth data at both zero degrees elevation and 20 degree elevation offsets.

Computed elevation and azimuth antenna patterns are shown in FIGS. 8 and 9. As shown in FIG. 8, this embodiment provided desired coverage over an elevation angle range from 45 degrees below horizontal to 45 degrees above horizontal, and beyond. As shown in FIG. 9, this embodiment provided desired coverage omnidirectionally at zero degrees elevation angle, with slightly lower gain at elevation angles of minus 20 degrees and plus 20 degrees. The variation of gain with azimuth angle shown in FIG. 9 is related to characteristics of the four-sided cylindrical side portion 22 and is operationally acceptable, but may be smoothed by use of a circular coaxial cavity. For present purposes, the term "omnidirectional" is used consistent with *The New IEEE Standard Dictionary of Electrical and Electronics Terms* definition: An antenna having an essentially nondirectional pattern in a given plane of the antenna and a directional pattern in any orthogonal plane. Consistent with the description above, antenna gain may be modified by adjustment of the vertical aperture of the radial waveguide radiator (i.e., vertical spacing between disks 62 and 64) while maintaining waveguide characteristics to provide a 90 degree mode differential at the disk circumference, if a circularly polarized antenna pattern is desired. For some applications, an elliptically polarized pattern may be appropriate, as determined by skilled persons.

By way of example, for a particular design of an antenna of the form shown in FIG. 1, for reception and transmission in a 36.7 to 37.0 GHz band, approximate antenna dimensions were as follows:

| | |
|---|---|
| antenna height: | 0.30 inches |
| antenna width: | 0.73 inches |
| slot length: | 0.14 inches |
| slot angle | 40 degrees to horizontal |

Contained within a very small package, the antenna may additionally include a protective radome or cover of suitable transmissive properties, for weather and damage protection, and an antenna mounting arrangement, as may be provided by skilled persons employing known design techniques.

While there have been described currently preferred embodiments of the invention, those skilled in the art will recognize that other and further modifications may be made without departing from the invention and it is intended to claim all modifications and variations as fall within the scope of the invention.

What is claimed is:

1. An antenna, providing an omnidirectional circularly polarized antenna pattern, comprising:

a coaxial line section structure with a vertical center axis and comprising an outer conductor with upper and lower closures, the outer conductor having a plurality of slanted openings between said closures;

a center onductor extending vertically within said coaxial line section structure along said vertical center axis;

upper and lower disk members extending in parallel relation outward from said outer conductor respectively above and below said slanted openings forming a radial waveguide radiator; and an input/output port coupled to said center conductor.

2. An antenna as in claim 1, wherein said outer conductor is four-sided with a square cross section and one said slanted opening in each side.

3. An antenna as in claim 1, wherein said upper and lower closures of said outer conductor comprise horizontal conductive surfaces.

4. An antenna as in claim 1, wherein said upper and lower disk members have a vertical spacing from each other of nominally 0.8 wavelength and a diameter of nominally 2.8 wavelengths, at an operating frequency.

5. An antenna as in claim 1, wherein said coaxial line section structure has a height of nominally one wavelength and a width of nominally one-half wavelength, at an operating frequency.

6. An antenna, comprising:

a coaxial line section structure including a center conductor extending vertically within an outer conductor having upper and lower closures, the outer conductor including a plurality of slanted openings spaced between said closures;

upper and lower disk members extending in parallel relation outward from said outer conductor respectively above and below said slanted openings forming a radial waveguide radiator; and an input/output port coupled to said center conductor.

7. An antenna, as in claim 6, wherein said outer conductor has a square cross section and four slanted openings that defined as slot radiators.

8. An antenna as in claim 6, wherein said upper and lower closures of said outer conductor comprise horizontal conductive surfaces.

9. An antenna as in claim 6, wherein said coaxial line section structure has a height of nominally one wavelength and a width of nominally one-half wavelength, at an operating frequency.

10. An antenna as in claim 6, wherein said disk members have a vertical spacing from each other of nominally 0.8 wavelength and a diameter of nominally 2.8 wavelengths, at an operating frequency.

11. A method, for providing an omnidirectional circularly polarized antenna pattern, comprising the steps of:

(a) energizing a coaxial line section structure having a center conductor and an outer conductor;

(b) responsive to step (a), exciting a radiation pattern external to said coaxial line section structure via a plurality of slanted openings in said outer conductor; and (c) responsive to step (b), exciting a radial waveguide radiator, formed by upper and lower disks extending outward in parallel relation from said outer conductor respectively above and below said slanted openings, to provide an omnidirectional circularly polarized antenna pattern.

12. A method as in claim 11, wherein said plurality of slanted openings is configured to excite horizontal TE mode and vertical TEM mode components at the outer circumference of said disks spaced with a 90 degree phase difference.

13. A method as in claim 11, wherein in step (a) said coaxial line section structure is energized via an input/output port coupled to said center conductor.

14. A method as in claim 11, wherein step (a) comprises energizing said coaxial line section structure having a length of nominally one wavelength and a width of nominally one-half wavelength, at an operating frequency.

15. A method as in claim 11, wherein step (a) comprises energizing said coaxial line section structure of square cross section and having one slanted opening in each of its four sides, each forming a slot radiator.

* * * * *